US009567185B2

(12) United States Patent
Ishii et al.

(10) Patent No.: US 9,567,185 B2
(45) Date of Patent: Feb. 14, 2017

(54) SHEET FOLDING DEVICE

(75) Inventors: Tsutomu Ishii, Midori (JP); Keiichi Arai, Midori (JP)

(73) Assignee: TAIYOUGIKEN CO., LTD., Midori-shi, Gunma (JP)

( * ) Notice: Subject to any disclaimer, the term of this patent is extended or adjusted under 35 U.S.C. 154(b) by 0 days.

(21) Appl. No.: 14/395,097

(22) PCT Filed: Apr. 24, 2012

(86) PCT No.: PCT/JP2012/060947

§ 371 (c)(1),
(2), (4) Date: Oct. 17, 2014

(87) PCT Pub. No.: WO2013/161003

PCT Pub. Date: Oct. 31, 2013

(65) Prior Publication Data

US 2015/0133282 A1 May 14, 2015

(51) Int. Cl.

| | |
|---|---|
| ***B31B 7/00*** | (2006.01) |
| ***B65H 45/16*** | (2006.01) |
| ***B65H 45/14*** | (2006.01) |
| ***B65H 29/20*** | (2006.01) |
| ***B65H 29/52*** | (2006.01) |
| ***B65H 43/00*** | (2006.01) |

(52) U.S. Cl.

CPC ..... *B65H 45/16* (2013.01); *B65H 29/20* (2013.01); *B65H 29/52* (2013.01); *B65H 43/00* (2013.01); *B65H 45/144* (2013.01); *B65H 2513/22* (2013.01); *B65H 2601/2532* (2013.01)

(58) Field of Classification Search

CPC ..... B65H 45/142; B65H 45/12; B65H 45/14; B65H 45/144; B65H 45/147; D06F 89/00

USPC ..... 493/419

See application file for complete search history.

(56) References Cited

U.S. PATENT DOCUMENTS 3,874,652 A * 4/1975 Bilbrey ..... B65H 3/042 235/474
3,942,785 A * 3/1976 Stange ..... 271/65
4,061,326 A * 12/1977 Proudman ..... 493/14
4,486,012 A * 12/1984 Bock et al. ..... 271/3.15
4,579,332 A * 4/1986 Larson ..... B65H 3/5238 271/121
4,708,462 A * 11/1987 Stemmle ..... G03G 15/23 271/186
4,708,468 A * 11/1987 Stemmle ..... G03G 15/23 271/144
5,269,505 A * 12/1993 Sardano ..... B65H 3/5238 271/121
5,449,164 A * 9/1995 Quesnel et al. ..... 271/186
6,244,591 B1 * 6/2001 Paulat ..... 271/225
6,446,958 B1 * 9/2002 Sette et al. ..... 271/225
8,505,908 B2 * 8/2013 Gendreau ..... B65H 29/14 271/182

* cited by examiner

*Primary Examiner* — Sameh Tawfik
(74) *Attorney, Agent, or Firm* — Sughrue Mion, PLLC; Richard C. Turner

(57) ABSTRACT

Provided is a sheet folding device comprising a deceleration means which halts a sheet by pressing. A pressure member such as rubber is disposed upon the leading end of a rod-shaped member which is rotatably retained. A sheet is decelerated by the pressure member being applied obliquely to the sheet. The entire surface of the rubber does not make close contact with paper, and thus, a wrinkle is not formed in the paper. It is possible to ensure a stable folding location.

3 Claims, 15 Drawing Sheets correction table

| velocity | | |
|---|---|---|
| first velocity | second velocity | third velocity |
| λ1 | λ2 | λ3 |

correction table

| velocity | | |
|---|---|---|
| first velocity | second velocity | third velocity |
| λ1 | λ2 | λ3 |

solenoid driving time setting table

| | | sheet size signal | | | |
|---|---|---|---|---|---|
| | | first size | second size | third size | fourth size |
| velocity | first velocity | τ11 | τ12 | τ13 | τ14 |
| | second velocity | τ21 | τ22 | τ23 | τ24 |
| | third velocity | τ31 | τ32 | τ33 | τ34 |

SHEET FOLDING DEVICE

CROSS REFERENCE TO RELATED APPLICATIONS

This is a National Stage of International Application No. PCT/JP2012/60947 filed Apr. 24, 2012, the contents of which are incorporated herein by reference in its entirety.

TECHNICAL FIELD

The present invention relates to a sheet folding device including a sheet deceleration means for temporarily stopping or decelerating a sheet such as printed paper along a transportation route.

BACKGROUND ART

Conventionally, a sheet folding device including a sheet transportation means for drawing out sheets of paper stacked on a sheet loading unit one at a time so as to transport them, a sheet stopper for preventing the sheets transported by the sheet transportation means from traveling, and a sheet folding means for pinching and folding a bent portion of the sheet that has been prevented from traveling by the sheet stopper and partially bent as a result, is well known (Patent Document 1).

PRIOR ART DOCUMENTS

Patent Documents

[Patent Document 1] JP Hei 05-238637A
[Patent Document 2] JP Sho 60-23253A
[Patent Document 3] JP Sho 63-41377A
[Patent Document 4] U.S. Pat. No. 3,797,820A

SUMMARY OF THE INVENTION

Problem to be Solved by the Invention

Patent Document 2 discloses that a stopping member including rubber is attached rotatably along a predetermined axis, and the stopping member is then pressed against a piece of paper using a solenoid so as to stop it. However, since the entire rubber surface adheres to the paper through this method, the paper moves along with the stopping member or the paper becomes wrinkled. This cannot secure a stable folding location.

Patent Document 3 and Patent Document 4 disclose that a clamp is pressed against a sheet perpendicularly from above so as to stop it. However, the sheet may be damaged through this method as it is strongly pressed.

The present invention aims to resolve the above problems and provide a device for precisely folding a sheet of paper or the like at a predetermined location while reducing damage to the sheet.

Means of Solving the Problem

The present invention is a sheet folding device including sheet transportation means 11, 12, 13 and 14 for transporting a sheet S along a predetermined route, sheet deceleration means 6*a* and 6*b* for decelerating at least a part of the sheet while being transported by the sheet transportation means, folding means 11 and 13 and 11 and 14 for folding a part of the sheet that is bent as the result of deceleration by the sheet deceleration means, and a control unit for controlling the sheet deceleration means.

The sheet deceleration means includes a guide member 62 for receiving the sheet while being transported by the sheet transportation means; a stopping member that includes a plate-like pressing member 63 having a predetermined thickness and a pressing member attachment 66 having the pressing member on an end surface facing the sheet and is rotatably held at a predetermined fulcrum 68, wherein an edge ED1 of the pressing member presses the sheet traveling along the guide member against the guide member; and a stopping member driving part 65 for rotating the stopping member around the fulcrum.

The stopping member is positioned at a waiting location where the pressing member does not touch the sheet or at a pressing location where the edge of the pressing member touches the sheet but the entire surface of the pressing member does not touch the sheet, the stopping member moves from the waiting location to the pressing location by rotating in the same direction as the traveling direction of the sheet, and returns from the pressing location to the waiting location by rotating in the opposite direction to the traveling direction of the sheet, and the stopping member driving part rotates the stopping member from the waiting location to the pressing location in compliance with an instruction from the control unit.

BEST MODE FOR CARRYING OUT THE INVENTION

Figure 1:
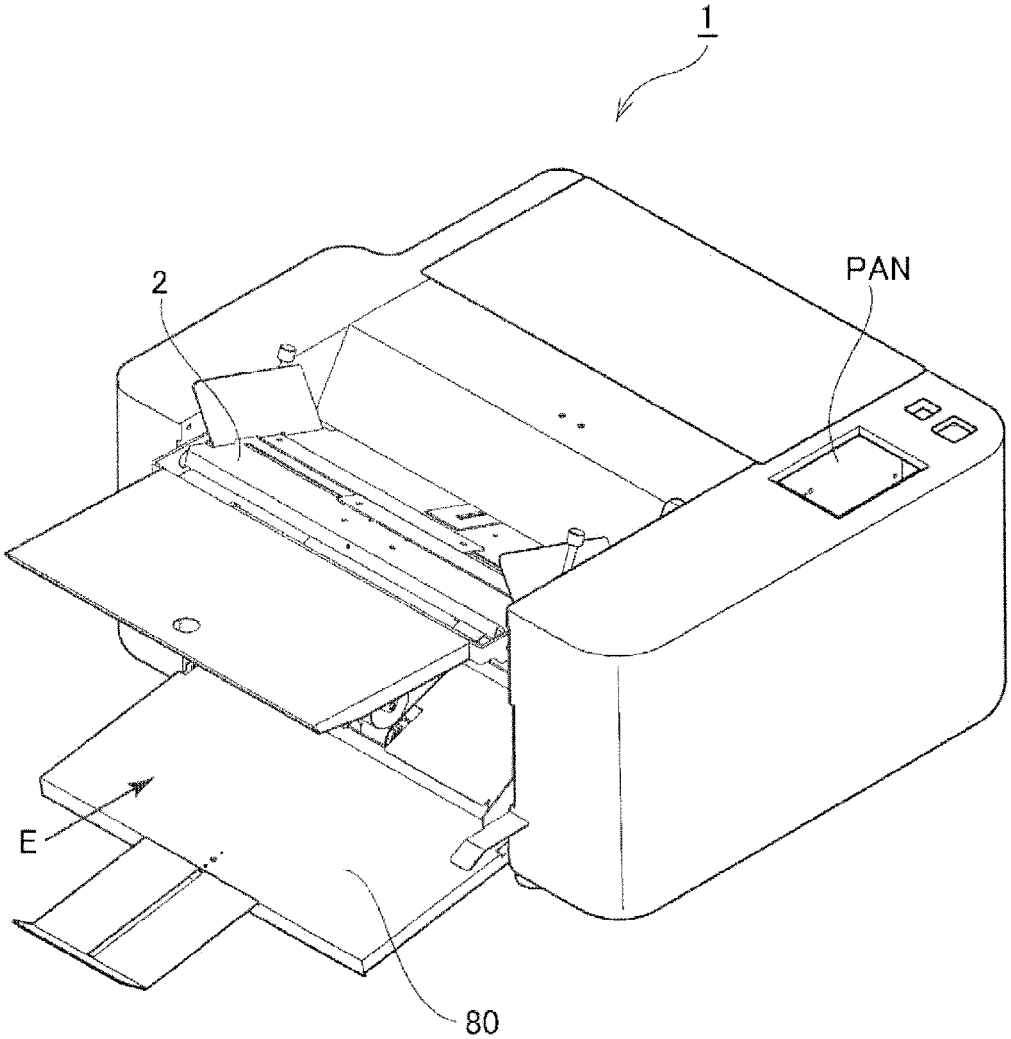
FIG. 1 is a perspective view of a sheet folding device according to an embodiment of the present invention.

FIG. 1 is a perspective view of a sheet folding device according to an embodiment of the present invention. A sheet folding device 1 includes a sheet stocker 2, which slants downward toward the inside of the device 1, a paper ejection tray 80, which is located therebelow, and an operation panel PAN for specifying a folding method for a sheet (paper). The paper ejection tray 80 is a sheet exit E.

Figure 2:
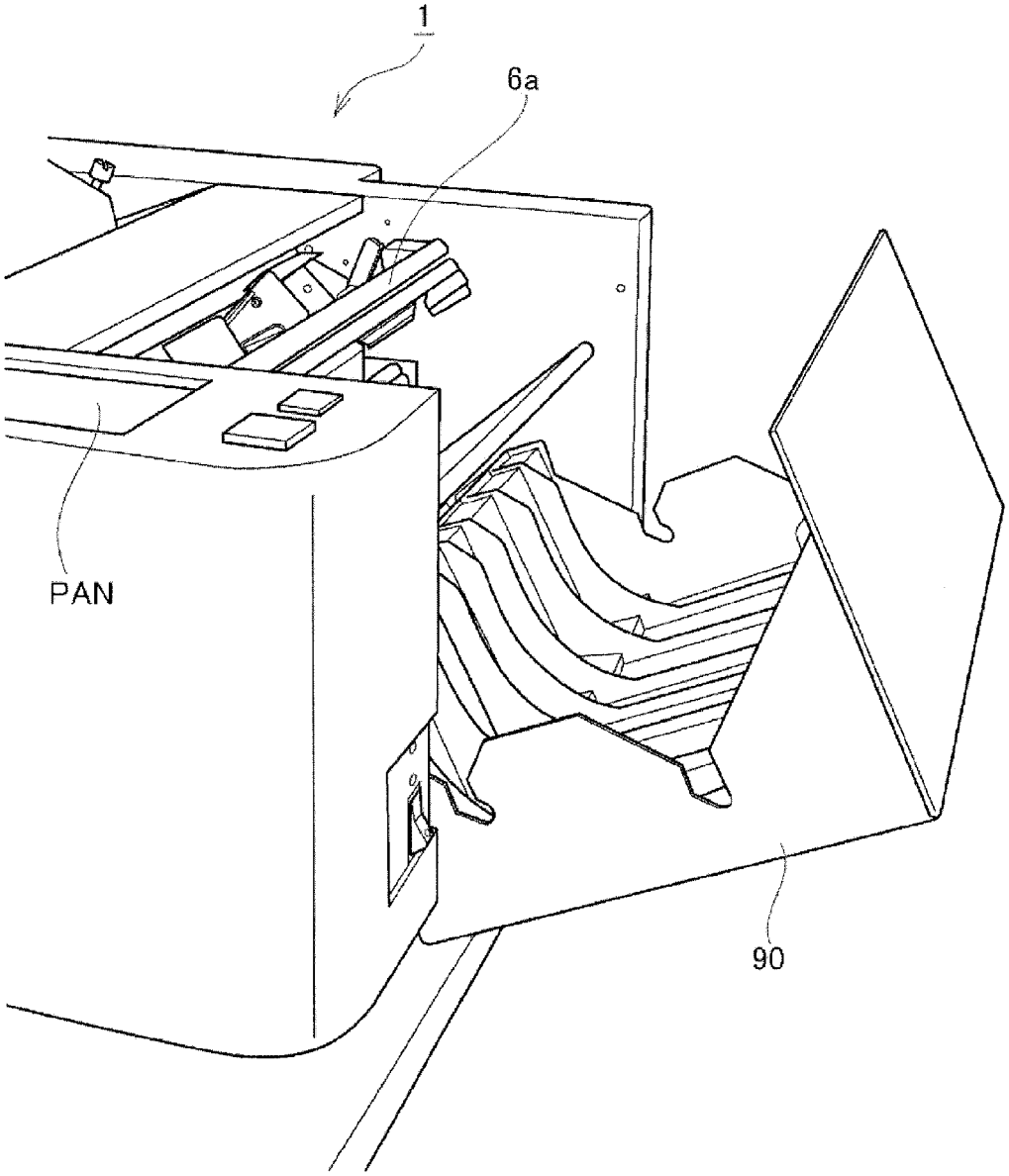
FIG. 2 is a drawing illustrating a state where an auxiliary guide member of the sheet folding device according to the embodiment of the present invention is pulled out.

As shown in FIG. 2, the back of the sheet folding device 1 is detachable. This back is made up of an auxiliary guide member 90, which has a curved inner surface that receives a sheet protruding from sheet deceleration means 6*a* and 6*b* described later.

Figure 3:
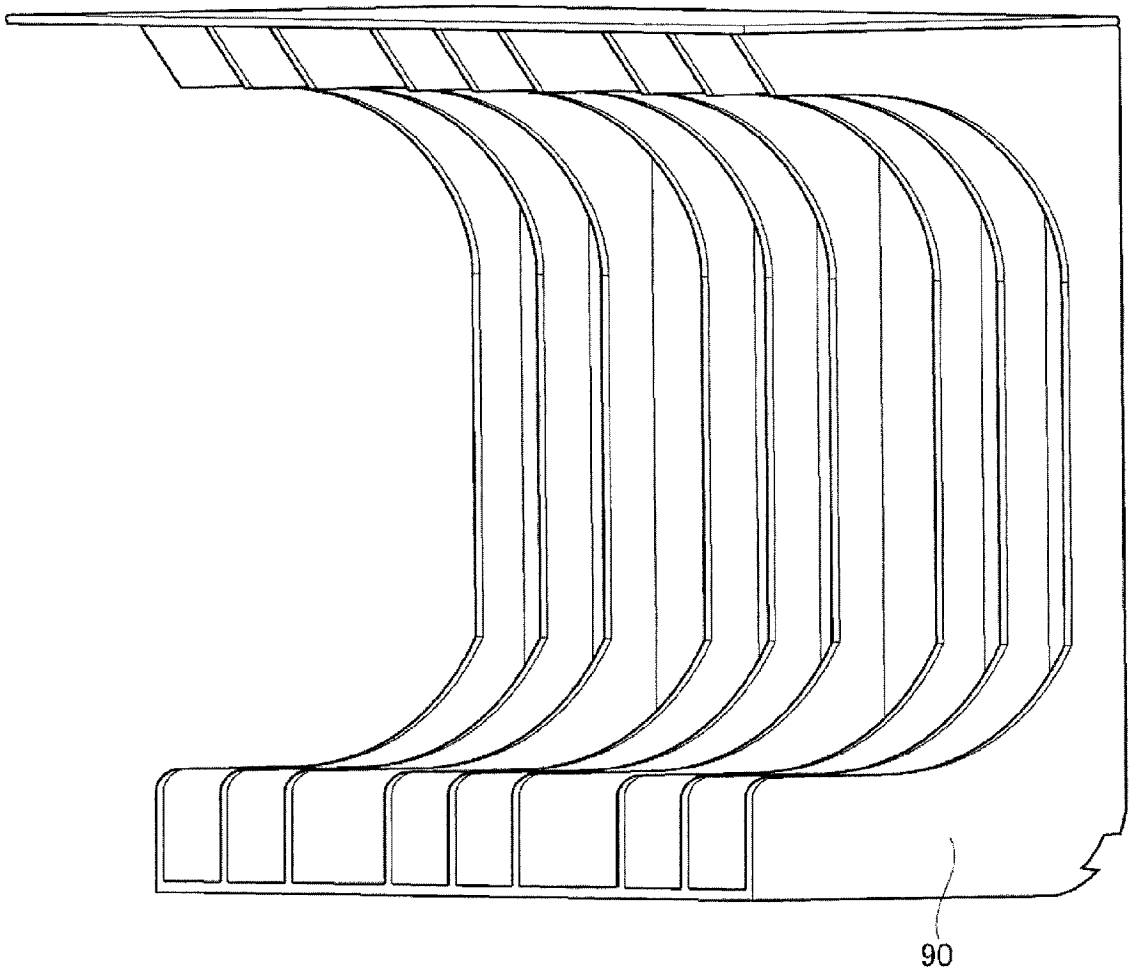
FIG. 3 is a perspective view of the auxiliary guide member according to the embodiment of the present invention.

The interior of the auxiliary guide member 90 is as illustrated in FIG. 3. A plurality of (nine) plates is provided in the sheet traveling direction. The shape of these plates is the same, as if the shape is made by cutting out from those plates using half of a Koban-shaped object (a half egg-shaped object). The angle thereof forms roughly a quarter of a circle.

Figure 4:
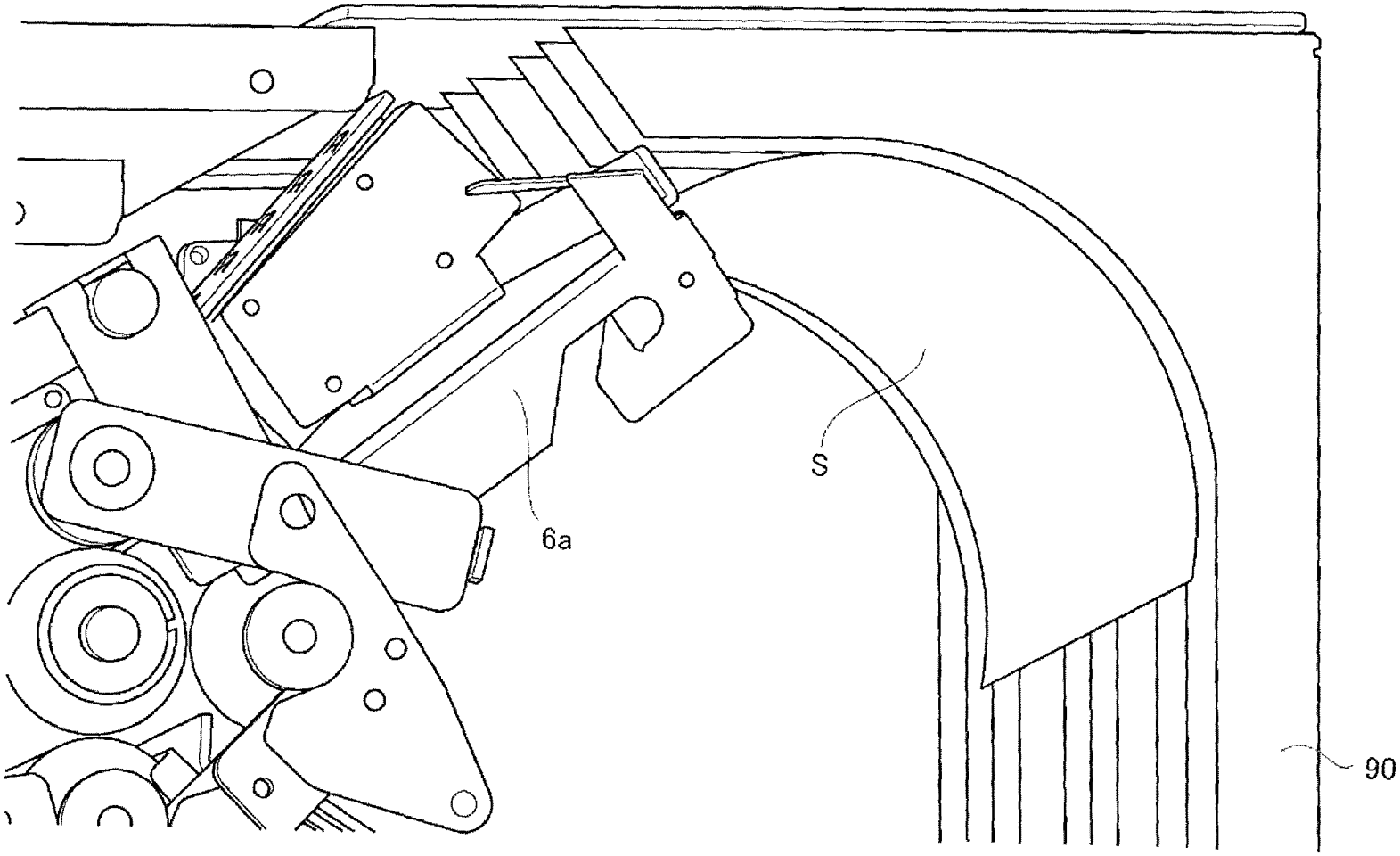
FIG. 4 is an operational schematic diagram of the auxiliary guide member according to the embodiment of the present invention.
Figure 5:
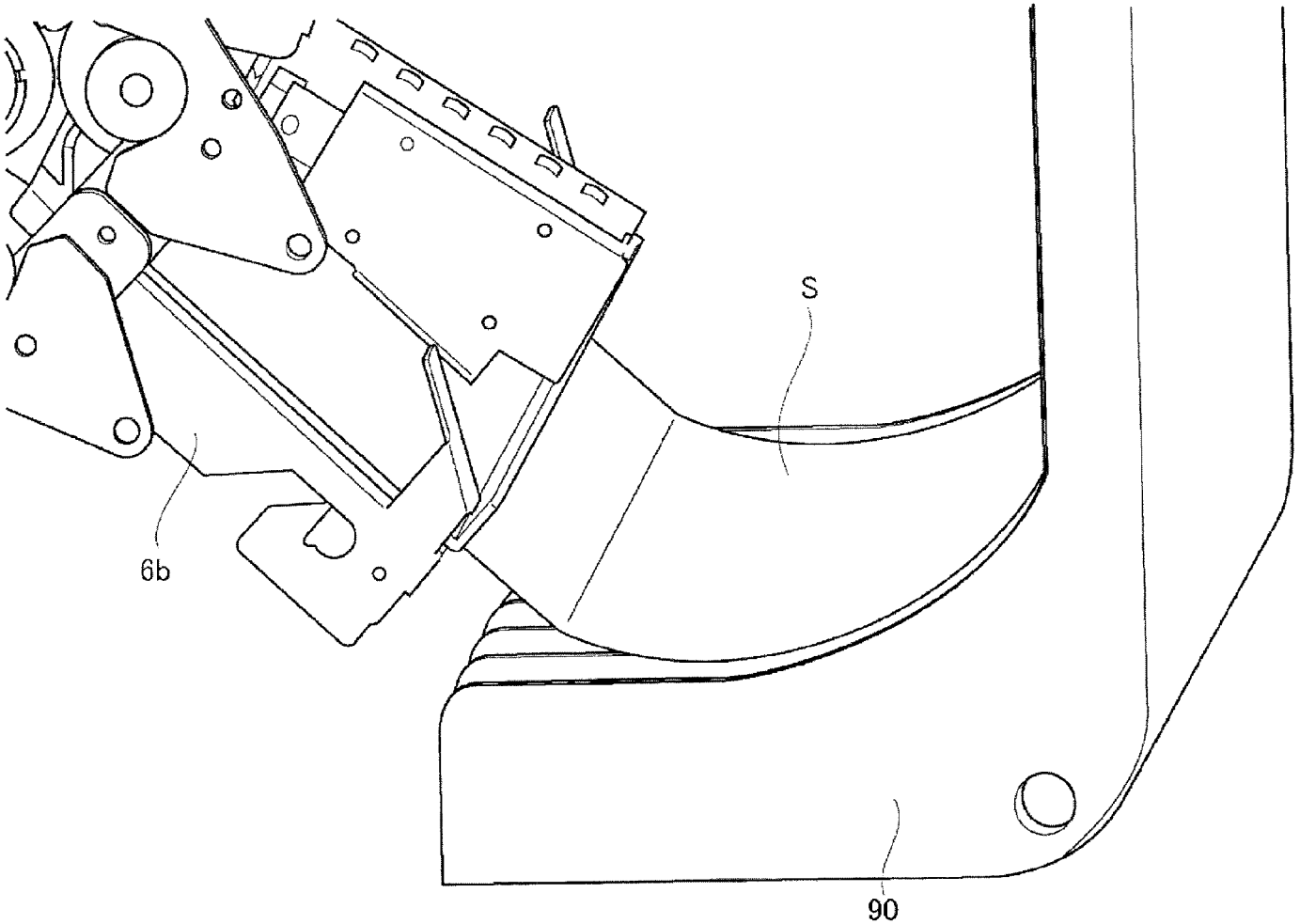
FIG. 5 is an operational schematic diagram of the auxiliary guide member according to the embodiment of the present invention.

The auxiliary guide member 90 receives at the cross section surfaces of the plates provided therewithin, a sheet protruding from the sheet deceleration means 6*a* and 6*b*, as shown in FIG. 4 and FIG. 5.

By providing the auxiliary guide member 90, the sheet deceleration means 6*a* and 6*b* may be smaller than the sheet and thus the sheet folding device 1 may be downsized.

Figure 6:
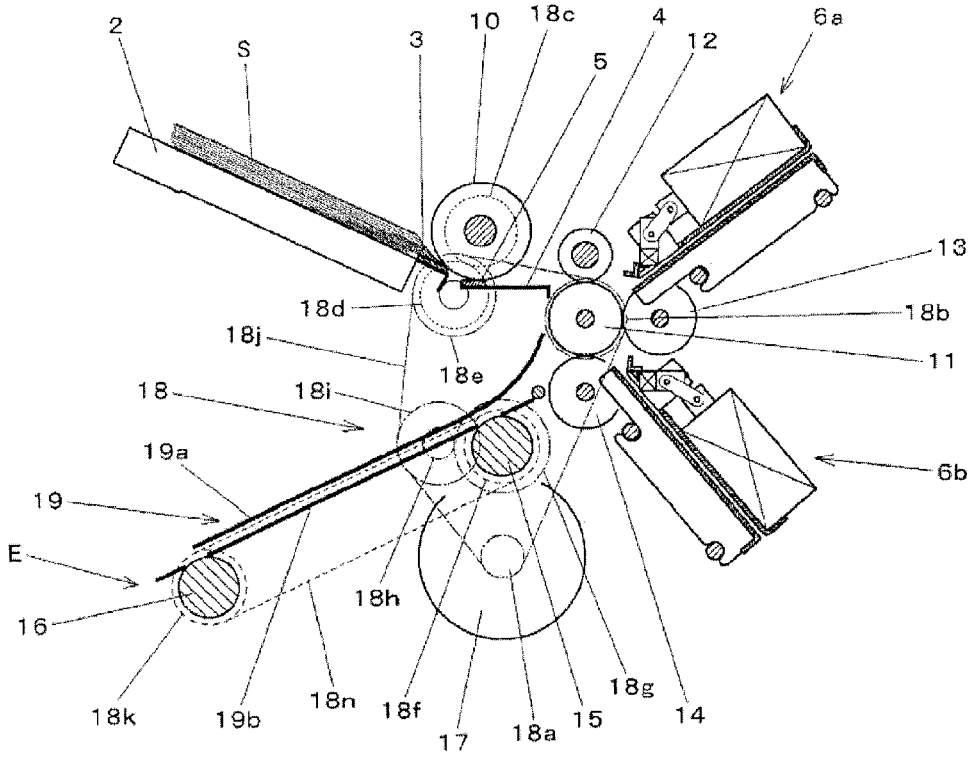
FIG. 6 is a schematic diagram of the internal structure of the sheet folding device according to the embodiment of the present invention.

Further description will be given while referencing FIG. 6.The sheet stocker 2 is a portion for stacking foldable sheets S (standard-size paper in this example) and stocking them. A separating plate 3 made of rubber or the like is provided on an end on the downside along the slope thereof. The sheets S stacked on the sheet stocker 2 are separated by the separating plate 3 and are drawn out one by one from the top sheet S.A sliding plate 4, which guides the sheet S that has passed over the separating plate 3, is provided in front of the sheet stocker 2.A separating plate 5 made of rubber or the like is provided on an end near the sheet stocker 2.

Other than this friction type, there is also a known air suction type. A friction type, an air suction type, or another means may be employed as a supply means.

Reference numeral 10 denotes a feed roller, which is provided above the separating plates 3 and 5, for rolling on and making contact with the upper surface of the sheet S that passes the separating plates 3 and 5.

Reference numeral 11 denotes a driving roller located on the downstream of the sheet S drawn out between the separating plate 5 and the feed roller 10.

Reference numerals 12, 13 and 14 denote follower rollers, which circumscribe the driving roller 11 and rotate synchronously.

Reference numerals 15 and 16 denote conveying rollers, which transport the sheet S that has passed between the driving roller 11 and the follower roller 14 to the exit E (this continues to the paper ejection tray 80).

The rollers 10 to 16 constitute a sheet transportation means for transporting the sheet S along a predetermined route.

The driving roller 11 and the follower roller 13 are also a folding means for folding a part of the sheet bent by the sheet deceleration means 6*a*. The driving roller 11 and the follower roller 14 are also a folding means for folding a part of the sheet bent by the sheet deceleration means 6*b*.

Reference numeral 17 denotes a motor (sheet transportation means driving part) for rotary driving the driving roller 11 and the conveying roller 15.

Reference numeral 18 denotes a transmission unit, which transmits the dynamic force of the motor 17. The transmission unit 18 includes a pulley 18*a* provided along an output shaft of the motor 17, a pulley 18*b* provided coaxially with the driving roller 11, a gear 18*c* provided coaxially with the feed roller 10, a gear 18*d* for outer gearing with the gear 18*c*, a pulley 18*e* provided coaxially with the gear 18*d*, a pulley 18*f* and a gear 18*g* provided coaxially with the conveying roller 15, a gear 18*h* for outer gearing with the gear 18*g*, a pulley 18*i* provided coaxially with the gear 18*h*, a timing belt 18*j* wound around the pulleys 18*a*, 18*b*, 18*e* and 18*i*, a pulley 18*k* provided coaxially with the conveying roller 16, and a flat belt 18*n* wound around the pulleys 18*f* and 18*k*.

Rotating the motor 17 allows simultaneous rotation of not only the feed roller 10 and the driving roller 11, but the follower rollers 12, 13 and 14, which circumscribe the driving roller 11, and the conveying rollers 15 and 16 as well. However, the feed roller 10 is made to intermittently rotate as a result of action of a clutch, which is omitted from the drawing, provided coaxially with the feed roller. This allows the sheets S on the sheet stocker 2 to be drawn out one by one at predetermined timings by the intermittently rotating feed roller 11 while consecutively rotating the driving roller 11 and the follower rollers 12, 13 and 14.

Reference numeral 19 denotes a conveyance path for leading the sheet having passed between the driving roller 11 and the follower roller 14 to the exit E. The conveyance path 19 includes paired upper and lower plates 19*a* and 19*b* that face each other in parallel and close proximity. The lower plate 19*b* is partially notched so as to expose the peripheries of the conveying rollers 15 and 16.

Reference numerals 6*a* and 6*b* respectively denote a sheet deceleration means. In FIG. 6, the sheet deceleration means 6*a* and 6*b* are arranged diagonally upward and diagonally downward, respectively, at locations facing the periphery of the driving roller 11. The angle between the sheet deceleration means 6*a* and 6*b* is approximately 90 degrees. The sheet deceleration means 6*a* and 6*b* temporarily decelerate the sheet S being transported by the sheet transportation means, so as to bend the sheet S. Note that 'deceleration' includes completely stopping the sheet S.

The upper sheet deceleration means 6*a* decelerates the sheet S fed between the driving roller 11 and the follower roller 12. The lower sheet deceleration means 6*b* decelerates the sheet S fed between the driving roller 11 and the follower roller 13.

Figure 7:
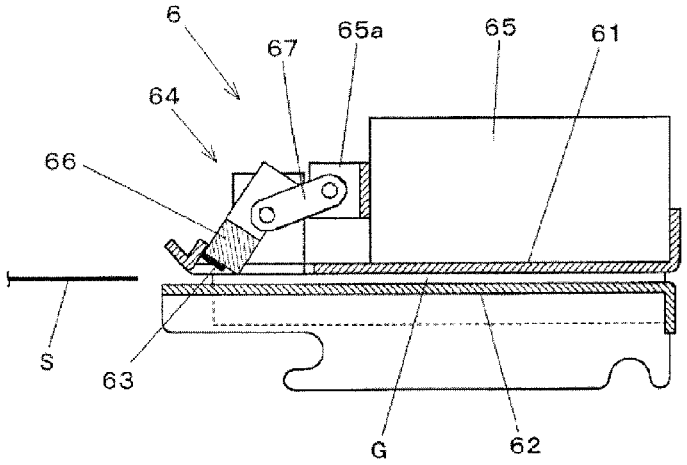
FIG. 7 is a side view illustrating a partially severed sheet deceleration means according to the embodiment of the present invention.
Figure 8:
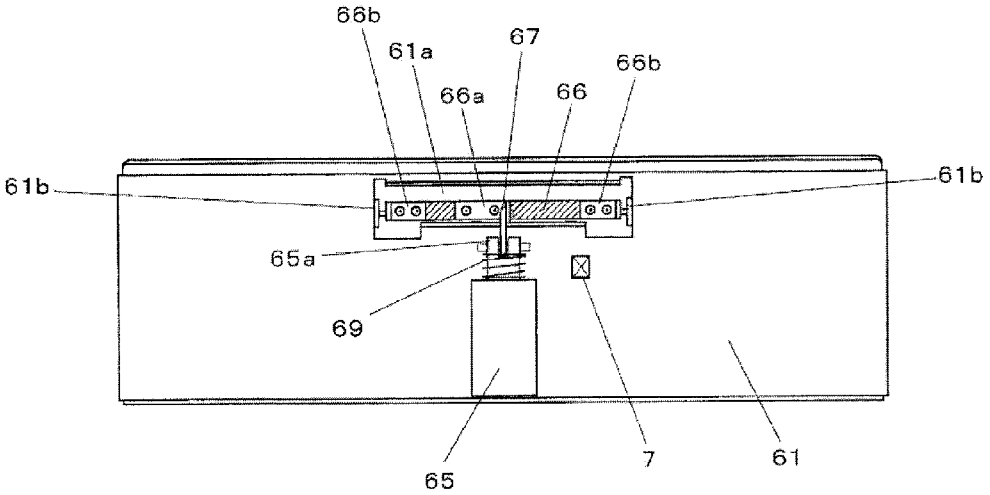
FIG. 8 is a top view of the sheet deceleration means according to the embodiment of the present invention.
Figure 9:
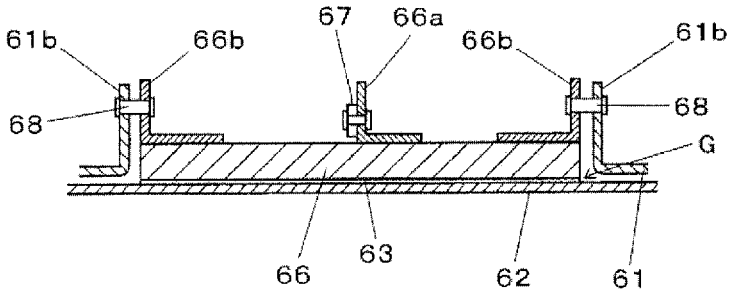
FIG. 9 is a partial expanded sectional view of the sheet deceleration means according to the embodiment of the present invention.

FIGS. 7 to 9 are the schematic diagrams of the sheet deceleration means 6*a* and 6*b*. As the sheet deceleration means 6*a* and 6*b* are the same, the signs 'a' and 'b' are omitted from the following description when differentiation therebetween is unnecessary.

The sheet deceleration means 6 includes an upper guide plate 61 and a lower guide plate 62, which face each other in parallel and close proximity via a gap G that allows the sheet S to enter. The upper guide plate 61 and the lower guide plate 62 are formed by pressing a steel sheet etc. The gap G formed between the upper guide plate 61 and the lower guide plate 62 is approximately 1 to 3 mm, for example.

Reference numeral 63 denotes a rubber pad pressing the sheet S that has entered the gap G onto the inner side (top side of the lower guide plate 62 in this example) of the gap G along the thickness thereof. The pad 63 is provided on the receiving end side of the gap G where the sheet S enters and exits, so as to control bending deformation of the sheet S in the gap G. In FIG. 7, the right side is the traveling direction of the sheet S. When the sheet S is folded, it returns to the opposite side from the traveling direction.

Reference numeral 64 denotes a pad transfer means for transferring the pad 63 between predetermined waiting and pressing locations. FIG. 7 illustrates the waiting location of the pad 63. The waiting location and the pressing location will be described in detail later.

The pad transfer means 64 includes a solenoid 65, which is deployed on the upper guide plate 61 as a driving source, a pad fixing bar 66, which is attached to the bottom of the pad 63, and a transmission link 67, which transmits a stretching force from the solenoid 65 to the pad fixing bar 66.

As shown in FIG. 8 and FIG. 9, the pad fixing bar 66 extends along the route orthogonal to the traveling direction of the sheet entering the gap G along the upper guide plate 61. The extending direction of the pad fixing bar 66 is parallel to the end of the sheet S. A bracket 66*a* is attached to the middle of the pad fixing bar 66. Paired brackets 66*b* are attached on either end along the length of the pad fixing bar 66. Note that in FIG. 8, hatching of the portion of the pad fixing bar 66 is for demonstrating the pad fixing bar 66 and is not a cross section.

While FIG. 8 and FIG. 9 show the pressing location, the entire surface of the pad 63 makes contact with the top surface of the sheet S or the inner surface of the lower guide plate 62. The pressing location in FIG. 8 and FIG. 9 is slightly different from the pressing location described in FIG. 11.

On the other hand, a long hole 61*a* resulting from cutting out a portion for the pad fixing bar 66 to be deployed, and brackets 61*b* and 61*b*, which result from bending up both ends of the long hole 61*a*, are formed on the upper guide plate 61. The brackets 61*b* and 61*b* and the brackets 66*b* and 66*b* are connected by pivots 68 and 68, respectively. An extension rod 65*a* for the solenoid 65 and the bracket 66*a* are connected by the transmission link 67. When the solenoid 65 is driven so as to extend, the pad fixing bar 66 rotates around the pivots 68 (carries out circular movement). This moves the pad 63 between the waiting location and the pressing location.

The brackets 61*b* may be metal blocks instead of lanced claws.

A coil spring 69 is provided to the extension rod 65*a*. Due to the resilience of this spring, the pad 63 is at the waiting location when the solenoid 65 is not being driven. When the solenoid 65 is driven, the extension rod 65*a* overcomes the resilience of the spring 69 and shortens, resulting in movement of the pad 63 to the pressing location. When there is no driving current, the solenoid 65 allows the resilience of the spring 69 to extend the extension rod 65*a*, resulting in movement of the pad 63 to the waiting location.

As shown in FIG. 8, a sheet entry sensor 7 is provided on the upper guide plate 61. This sensor 7 detects the end of the sheet entering the gap G. The sheet entry sensor 7 is a reflection type photoelectric switch, for example.

Description of the waiting location and the pressing location of the pad 63 will be described while referencing FIG. 10 and FIG. 11.

In the following description, the pad 63 (pressing member) and the pad fixing bar 66 (pressing member attachment) are depicted collectively as 'stopping members'.

Figure 11:
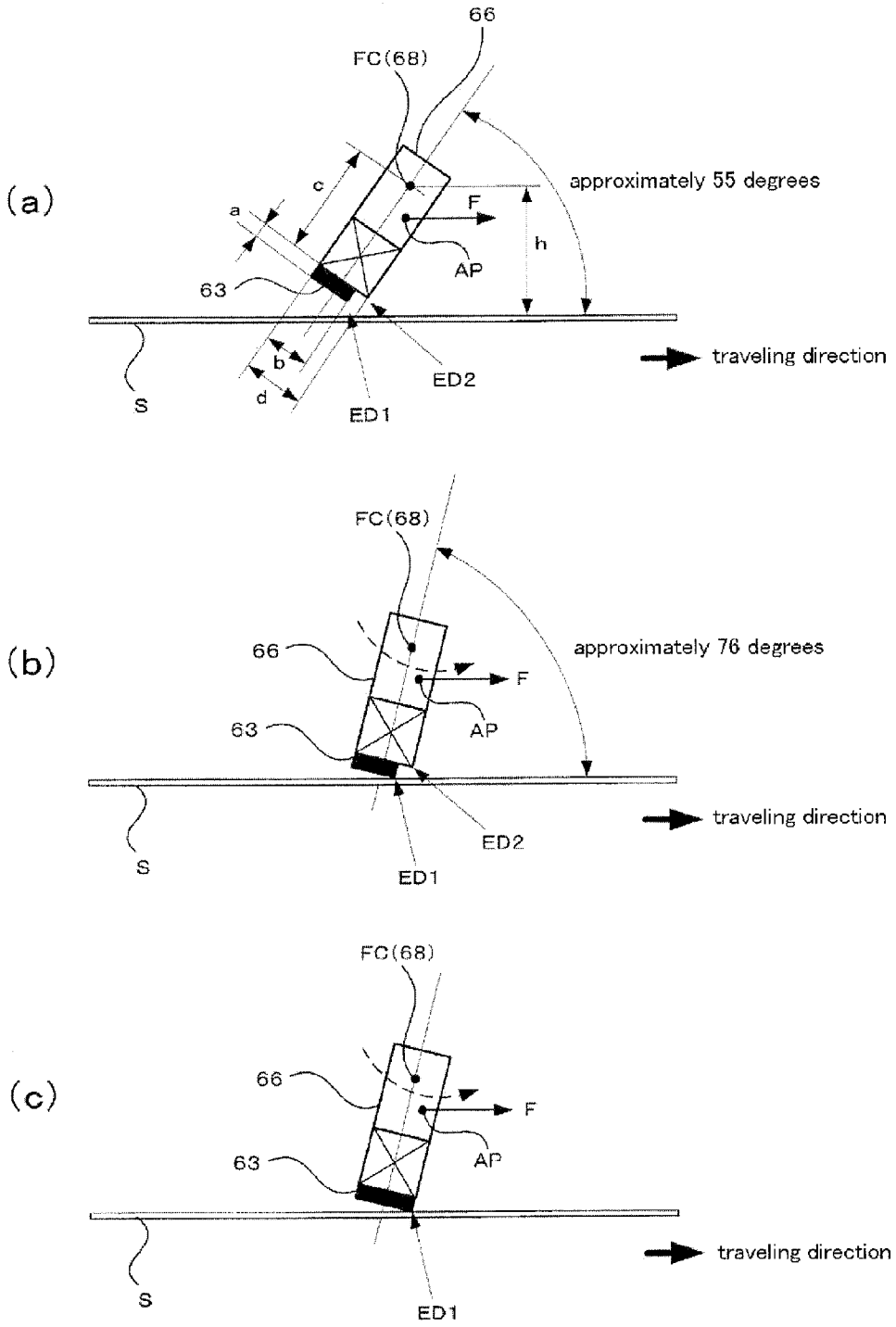
FIG. 11 is an operational schematic diagram of the stopping member of the sheet deceleration means according to the embodiment of the present invention.

Thickness of the pad 63 is 'a' in FIG. 11(*a*). The pad 63 is provided on the end (bottom) of the pad fixing bar 66 near the sheet S. The pad fixing bar 66 is held rotatably at a fulcrum FC. The fulcrum FC corresponds to the pivot 68.

AP denotes the point of action of the driving force of the solenoid 65, and F denotes acting force.

Figure 10:
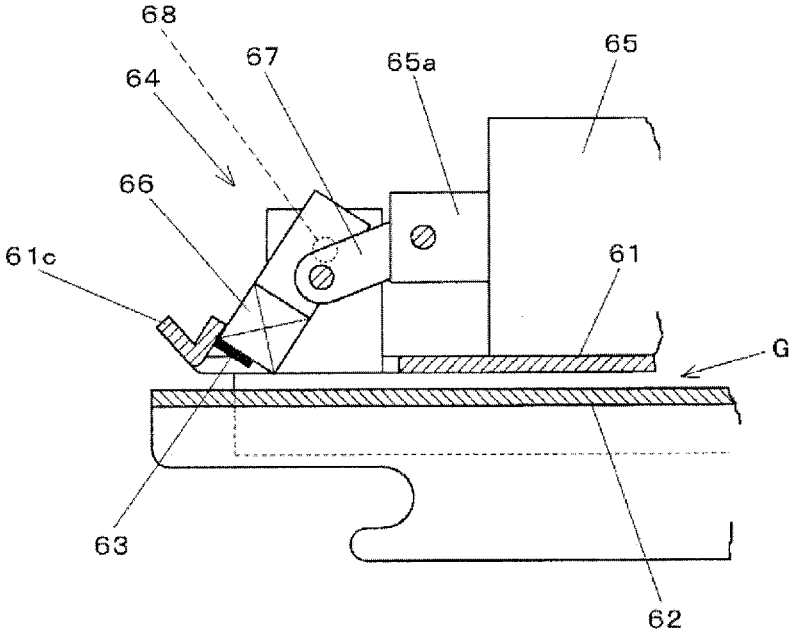
FIG. 10 is a side view illustrating the periphery of a stopping member of the sheet deceleration means, according to the embodiment of the present invention, and a waiting location.

In FIG. 10 and FIG. 11(*a*), the stopping members 63 and 66 are at the waiting location. That is, the pad 63 is not touching the sheet S. Reference numeral 61*c* in FIG. 10 denotes a stopping member stopper for keeping the stopping members 63 and 66 at the waiting location.

As shown in FIG. 11(*a*), at the waiting location, an angle made by a straight line of the surface of the pad 63 and the traveling direction of the sheet S is approximately 55 degrees.

In FIG. 11(*b*), the solenoid 65 is driven and the stopping members 63 and 66 are thus moved to the pressing location as indicated by a dotted line. That is, the sheet S is being pressed onto the inner surface of the lower guide plate 62 by an edge ED1 of the pad 63. Display of the lower guide plate 62 is omitted from FIG. 11.

The edge ED1 is on the farther end from the entry location of the sheet S, of the two edges of the pad 63 that are along the traveling direction of the sheet S. The edge ED1 touches the sheet S because the sum of the thickness a of the pad 63 and length c from the end surface (bottom) touching the sheet S of the pad fixing bar 66 to the fulcrum FC is slightly smaller than distance h from the fulcrum FC to the sheet S.

As shown in FIG. 11(*b*), at the pressing location, an angle made by a straight line of the surface of the pad 63 and the traveling direction of the sheet S is approximately 76 degrees. Difference between angles at the waiting location and the pressing location is approximately 20 degrees.

The stopping members 63 and 66 move from the waiting location to the pressing location by rotating approximately 20 degrees in the same direction as the traveling direction of the sheet S, and return from the pressing location to the waiting location by rotating approximately 20 degrees in the opposite direction to the traveling direction of the sheet S.

Length b of the pad 63 is shorter than length d of the end surface of the pad fixing bar 66. The pad 63 is provided near an end of the pad fixing bar 66 to which the sheet S enters first. Therefore, an edge ED2 (edge of the pressing member attachment), which is on the opposite side to the sheet S entry side of the end surface of the pad 63, is not covered by the pad 63. Therefore, the stopping members 63 and 66 of FIGS. 10, 11(*a*) and 11(*b*) have the two edges ED1 and ED2.

At the waiting location, neither of the two edges ED1 or ED2 is touching the sheet S (pressing against it). At the pressing location, the edge ED1 is touching the sheet S but the edge ED2 is not.

Figure 12:
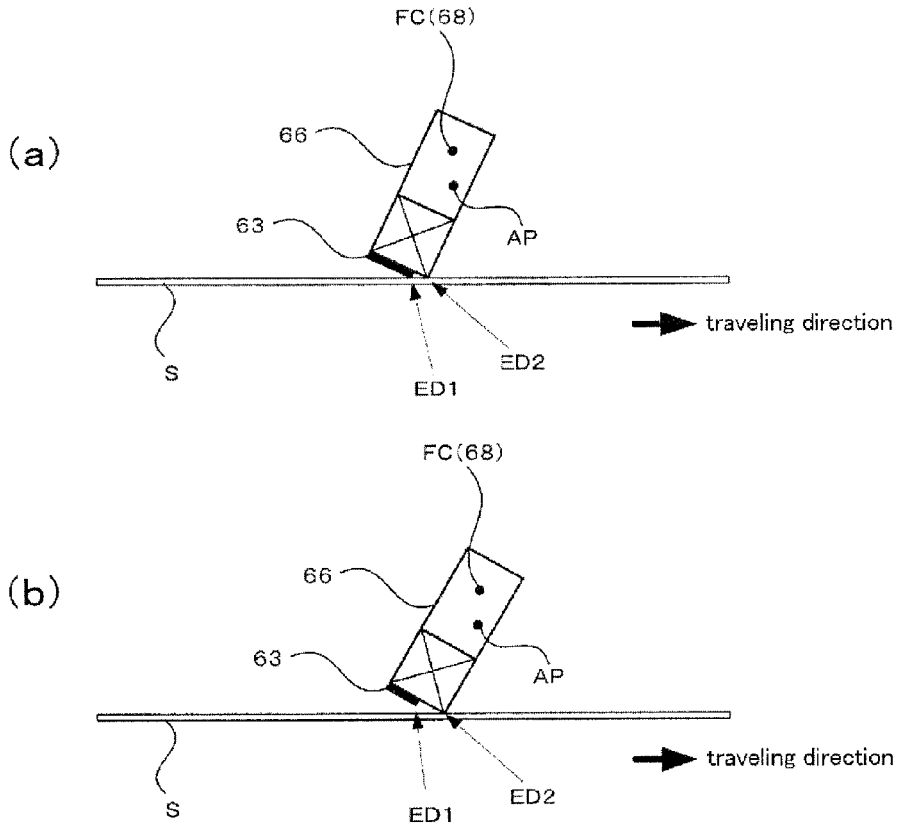
FIG. 12 is an operational schematic diagram (comparative example) of the stopping member according to the embodiment of the present invention.

If both of the two edges ED1 or ED2 at the pressing location are touching the sheet S, as in FIG. 12(*a*), and if the pad 63 is worn down, the edge ED2 of the metal part makes contact with the sheet S first, as in FIG. 12(*b*), and there is a danger that the sheet S cannot be stopped. There is also a danger of damaging the sheet S.

Therefore, while the edge ED1 is touching the sheet S at the pressing location, as shown in FIG. 11(*b*), even if the pad 63 has been worn down during the life expectancy of the product or between overhaul procedures, the thickness a of the pad 63 should be selected such that the edge ED2 does not touch the sheet S.

The stopping members 63 and 66 pressing as in FIG. 11(*b*) bring about the following effects.

1) Since the pad 63 is structured so as to move in a circular manner and the sheet S is braked by the edge ED1, the sheet may be securely held and sufficiently decelerated even when the sheet S is thick and moves fast. The pad 63 is pulled in the traveling direction of the sheet S by frictional force occurring between the sheets S as well as by the driving force of the solenoid 65, and the pad 63 thereby moves further in a circular manner. As a result, since the pad 63 is further strongly pressed against the sheet S, a greater braking force may be obtained. Application of the brake on the edge ED1 allows effective deceleration utilizing the traveling force of the sheet S.
2) By providing the stopping members 63 and 66 with the two edges ED1 and ED2, the sheet S is not blocked from traveling when returning to the opposite direction to the traveling direction nor is the sheet S damaged. While the sheet S travels along the bottom surface (inner surface of the lower guide plate 62) when advancing in the traveling direction, it travels along the top surface (surface of the pad 63) when returning in the opposite direction. As the pad 63 is not between the edges ED1 and ED2 at this time, blockage of traveling of the sheet S is reduced.
3) The angle made by the straight line perpendicular to the surface of the pad 63 and the traveling direction of the sheet S is made smaller than 90 degrees at the pressing location, and thus sufficient deceleration of the sheet S and security of a stable folding location are possible. If the angle becomes 90 degrees and the entire surface of the pad 63 touches the sheet S, a stable folding location cannot be secured. If the angle exceeds 90 degrees, the sheet S cannot be stopped. Contrary to the above effect 1, braking becomes weaker due to the traveling force of the sheet S.

FIG. 11(*c*) illustrates an example where the length b of the pad 63 is the same as the length d of the end surface of the pad fixing bar 66. There is no edge ED2 in this example. The working example of FIG. 11(*c*) does not bring about the above-given effect 2, but does lead to the effects 1 and 3.

Figure 13:
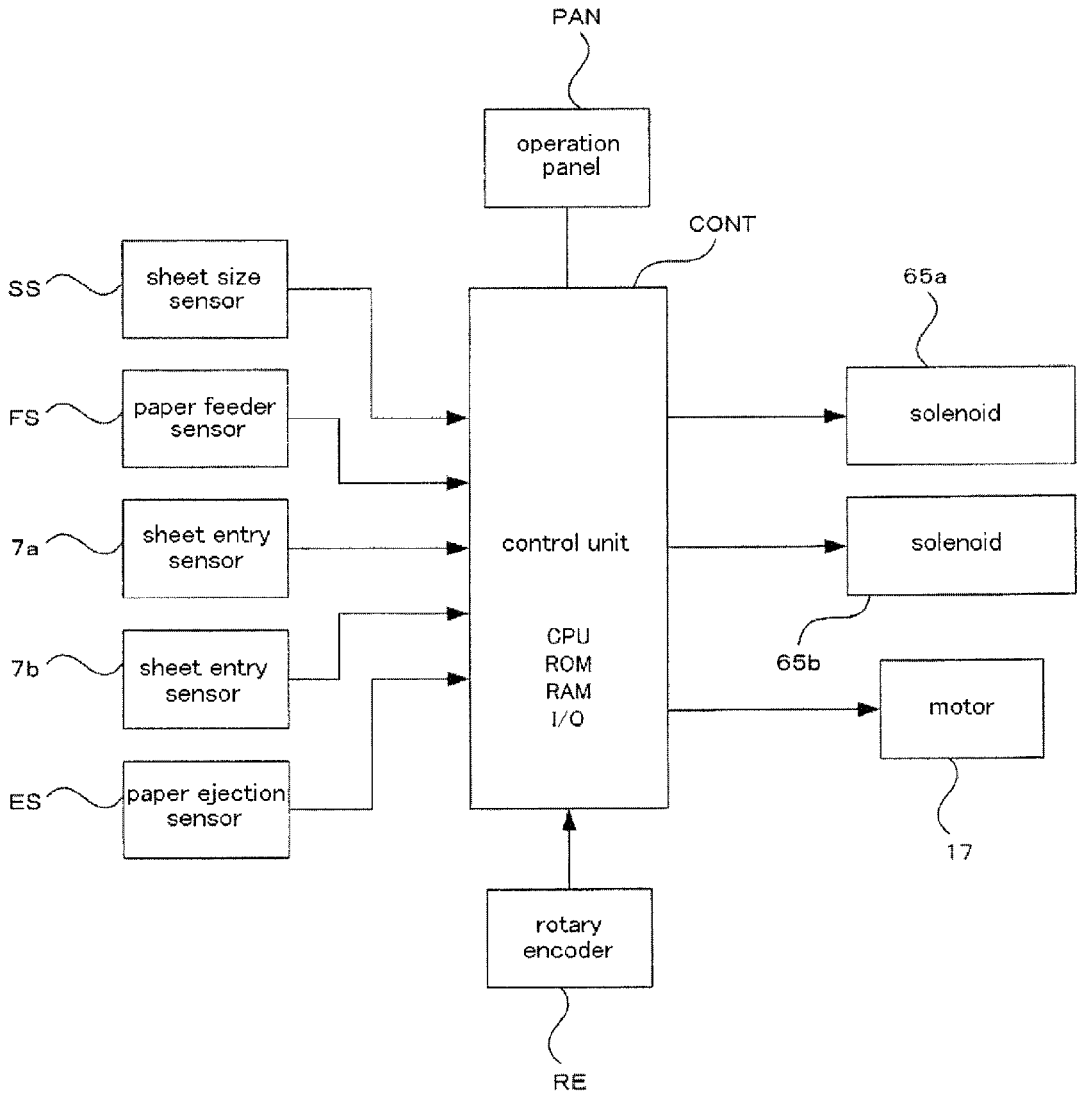
FIG. 13 is a block diagram of a control system for the device according to the embodiment of the present invention.

A control system of the device according to the embodiment of the present invention will be described while referencing FIG. 13.

CONT denotes a control unit for controlling the solenoids 65*a* and 65*b* and the motor 17 based on signals from an operation panel PAN and a plurality of sensors. The control unit CONT includes a CPU, ROM, RAM, and I/O ports. Controlling is carried out by the CPU executing a program stored in the ROM.

A signal for instructing a folding method for a sheet S, for example, is transmitted from the operation panel PAN. Folding methods will be described while referencing FIG. 20 and the description thereof.

Sensors connected to the control unit CON are given below.

A sheet size sensor SS is for detecting the size of a sheet S placed on the sheet stocker 2. Detected sizes are A4, A3, etc. The sheet size sensor SS is well known to those skilled in the art and therefore detailed description thereof is omitted.

Note that the size of the sheet S may be input from the operation panel PAN instead of using the sheet size sensor SS. There are cases when provision of the sheet size sensor SS is unnecessary.

A paper feed sensor FS is for detecting that the sheet S has been loaded onto the sheet transportation means 10 to 16. The paper feed sensor FS is an optical sensor (photointerrupter or the like), for example, and is provided near the separating plate 3 or the feed roller 10, for example.

Sheet entry sensors 7*a* and 7*b* are for detecting entry of the sheet S to the sheet deceleration means 6*a* and 6*b*, respectively. An example of installation locations is given in FIG. 8.

A paper ejection sensor ES is for detecting ejection of a folded sheet S. The paper ejection sensor ES is provided at the exit E.

A rotary encoder RE is a sensor for detecting the amount of rotation of the driving roller 11. A rotating shaft of the rotary encoder RE is connected to the rotating shaft of the driving roller 11 directly or via a transmission mechanism such as a gear or the like. When the driving roller 11 is rotated, the rotary encoder RE outputs a pulse in compliance with the rotation angle. For example, the driving roller 11 outputs a single pulse for every $\Delta\theta$ rotation. Counting the number of pulses may give the rotation angle of the rotating roller 11. The distance moved by the sheet S may also be known based on the number of pulses.

Figure 14:
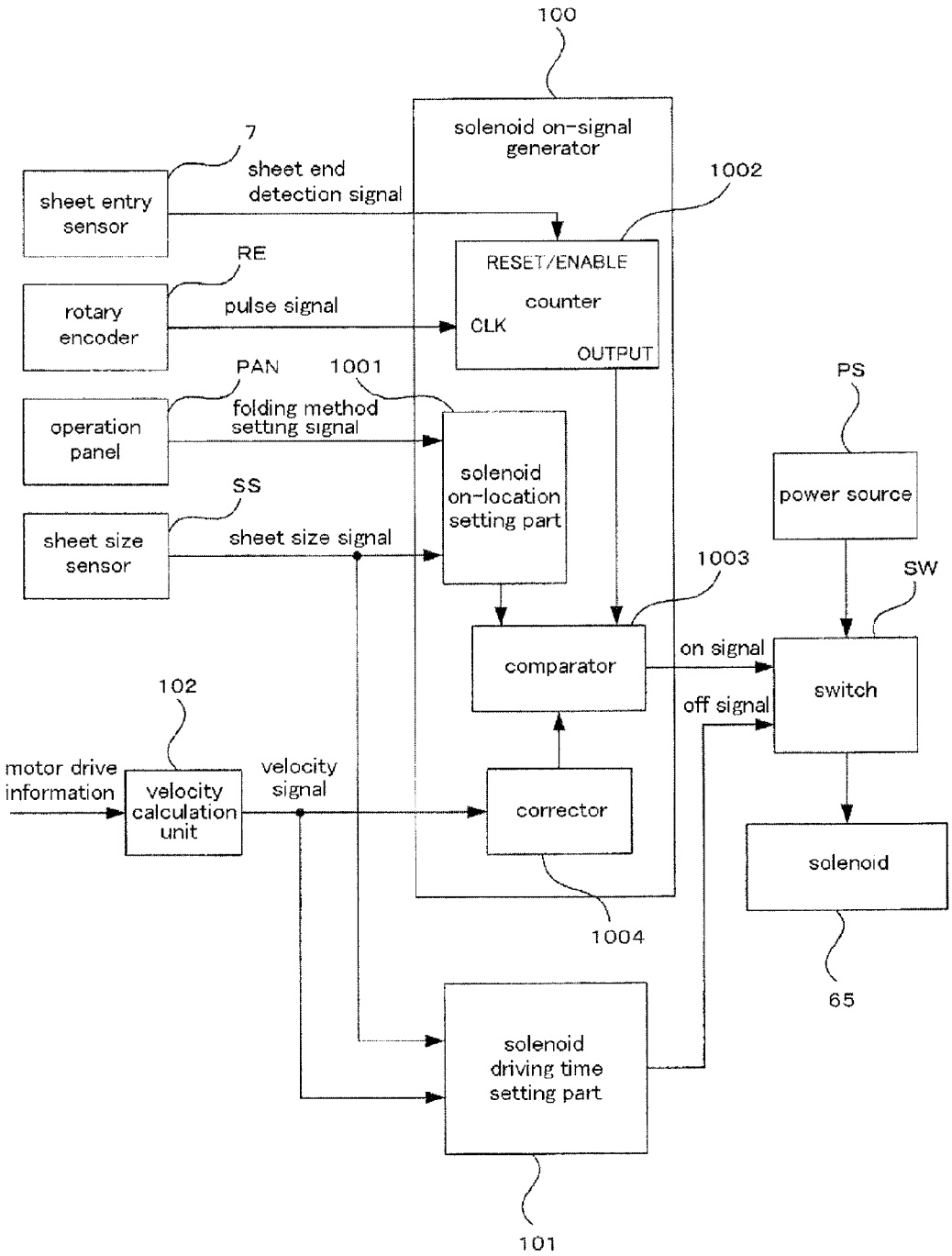
FIG. 14 is a block diagram of a control system for the sheet deceleration means according to the embodiment of the present invention.

Control of the stopping members 63 and 66 will be described while referencing FIG. 14. FIG. 14 illustrates a control system of the sheet deceleration means 6*a* or the control system of the sheet deceleration means 6*b*. Content of controlling both means is almost the same, and thus the sheet deceleration means 6*a* and 6*b* are not differentiated nor are 'a' and 'b' notated in the following description.

The control system of FIG. 14 is implemented by the CPU executing a program. The control system may also be implemented by hardware such as an IC.

Reference numeral 100 denotes a solenoid on-signal generator, which controls so as to start driving the solenoid 65 at a time (t1 in FIG. 15) after a predetermined period of time (T1 in FIG. 15 or pulse number PN1, or otherwise a corrected pulse number PN1' when correction described later has been performed) has elapsed from a time (t0 in FIG. 15) when entry of the sheet S (end of the sheet 5) is detected by the sheet entry sensor 7.

Reference numeral 101 denotes a solenoid driving time setting part, which sets a period of time (T2 in FIG. 15) that the solenoid 65 is driven and controls so as to stop driving the solenoid 65 at a time (t2 in FIG. 15) after this period of time has elapsed.

Reference numeral 102 denotes a velocity calculation unit, which calculates the driving velocity of the motor 17 based on drive information (e.g., electric current) of the motor 17. For example, when driving currents are I0, I1 and I2, it can be known in advance that the driving velocities are v0, v1 and v2 respectively, thereby allowing calculation of the velocity utilizing this information.

SW denotes a switch for turning on and off a current flowing from a power source PS to the solenoid 65. The switch SW turns on according to an output of the solenoid on-signal generator 100 and turns off according to an output of the solenoid driving time setting part 101.

The solenoid on-signal generator 100 includes a solenoid on-location setting part (drive starting information setting part) 1001, which sets a drive starting time for the solenoid (stopping member driving part) 65, which drives the stopping members 63 and 66, based on an instruction on folding method for a sheet S from the operation panel PAN and an output from the sheet size sensor SS, a counter 1002, which starts counting output pulses from the rotary encoder RE when the sheet entry sensor 7 has detected the sheet S, a comparator 1003, which compares the counter 1002 to output from the solenoid on-location setting part 1001 and outputs an on signal to the switch SW when they coincide, and a corrector (correction table) 1004, which stores an adjustment time specified in accordance with the driving velocity of the motor (sheet transportation means driving part) 17.

The solenoid on-location setting part 1001 establishes a folding location based on aspects of the folding method (twofold, threefold, etc.) and size (A3, A4, etc.) of the sheet S. Since the procedure of establishing a folding location is well known to those skilled in the art, description thereof is omitted. The folding location which is the output of the solenoid on-location setting part 1001 is expressed as the output pulse number PN1 (the corrected pulse number PN1' when correction has been performed) of the rotary encoder RE.

The counter counts the number of output pulses from time t0 and onward. The comparator 1003 turns on the solenoid 65 when the counted number of pulses becomes PN1 (or PN1'). The time T1 corresponds to time required for the rotary encoder RE to output PN1 (or PN1') number of pulses. While the location (corresponds to PN1 or PN1') of the sheet S, which is braked by the stopping members 63 and 66, does not change, the period of time T1 changes depending on the rotating speed of the motor 17. The solenoid on-location setting part 1001 may be interpreted as setting times for turning on the solenoid 65 in accordance with the folding location.

Figures 15, 16, 17:
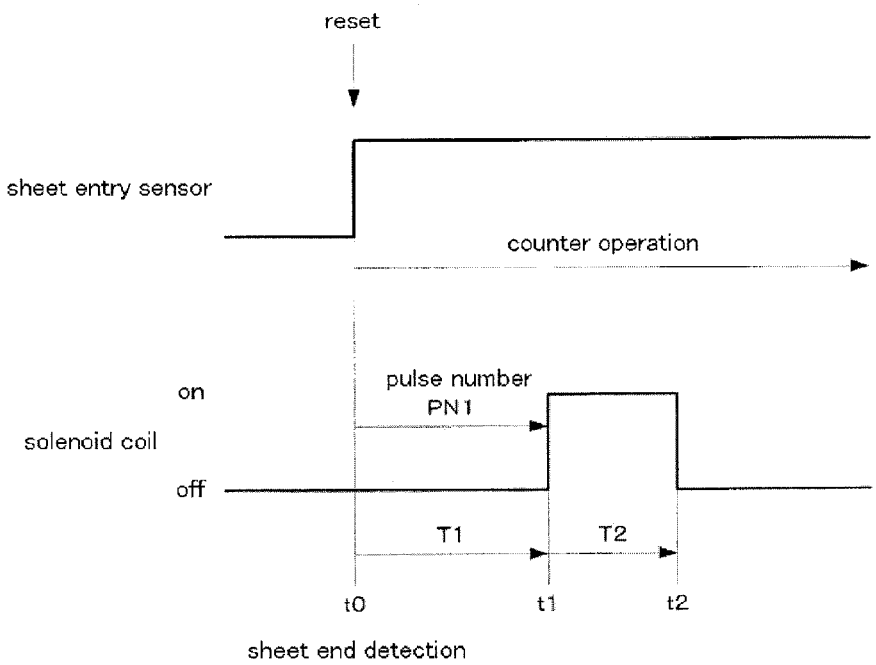
FIG. 15 is a schematic diagram (timing chart) of the sheet deceleration means according to the embodiment of the present invention.
FIG. 16 is a schematic diagram of a correction table according to the embodiment of the present invention.
FIG. 17 is a schematic diagram of a driving time setting table according to the embodiment of the present invention.

Meanwhile, there is a predetermined time delay ΔT from when the solenoid 65 is turned on to when a brake force is applied by the stopping members 63 and 66. The corrector (correction table) 1004 performs correction for removing adverse effects of ΔT. For example, it has the correction table given in FIG. 16, and corrects the value of PN1 in accordance with the driving velocity of the motor 17 to PN1'. In the example of FIG. 16, λ1 is subtracted from PN1 when the driving velocity equals a first velocity. Namely, PN1'=PN1−λ1. This corresponds to the actual period of time from sheet detection to sheet stopping in the case of correction resulting in PN1'. This correction may be performed by the solenoid on-location setting part 1001. Alternatively, it may be added to the output of the counter 1002. The same holds for λ2 and λ3.

The folding location (pulse number PN1) does not change due to the driving velocity of the motor 17, as described above; however, the corrector 1004 is necessary since the number of pulses generated at the time delay ΔT changes. The corrector 1004 may be interpreted as adjusting times for turning on the solenoid 65 using the adjusted values λ1, λ2 and λ3.

The adjusted values are established based on the time ΔT required for moving from the waiting location to the pressing location. The greater the driving velocity of the motor 17, the greater the absolute values of the adjusted values. In other words, the higher the driving velocity of the motor 17, the more t1 approaches t0 by correction. Supposing delay of the first velocity is ΔT1, the number of pulses output by the rotary encoder RE corresponds to the corrected value λ1. The solenoid driving time setting part 101 has a table as given in FIG. 17, for example. According to this drawing, when the sheet S is a first size and the driving velocity of the motor is a first velocity, time T2, which denotes the duration of the solenoid 65 being on, is τ11.

In FIG. 17, the greater the transporting velocity of the sheet S, the longer the driving time τ, and the larger the size (mass) of the sheet S, the longer the driving time τ. When size increases in order from the first size to fourth size and velocity increases in order from the first velocity to third velocity, relationships: τ11<τ12<τ13<τ14 and τ11<τ21<τ31 hold true.

Note that even if the mass of the sheet S is different, the driving time of the solenoid 65 may be not changed. In this case, τ11=τ12=τ13=τ14.

The stopping members 63 and 66 are for decelerating a sheet S, bending the sheet S, and folding the bent place using the folding means (the driving roller 11 and the follower roller 13). In order to achieve this aim, the stopping members 63 and 66 need to sufficiently decelerate the sheet S. Time necessary for deceleration is expressed as a function of size (mass) of the sheet S and travel speed thereof. Since kinetic energy of the sheet S is proportional to the mass and also proportional to the square of the travel speed, the driving time τ in the table of FIG. 17 is established such that the longer the time, the greater the transporting velocity of the sheet S, and the longer the time, the larger the size of the sheet S.

Note that when the driving time τ becomes too long, the sheet S is blocked from moving to the folding means. It is desirable that the driving time τ is long enough to achieve the above-given aim and bend the sheet S, and short enough such that it does not block the sheet S from moving to the folding means.

Figure 18:
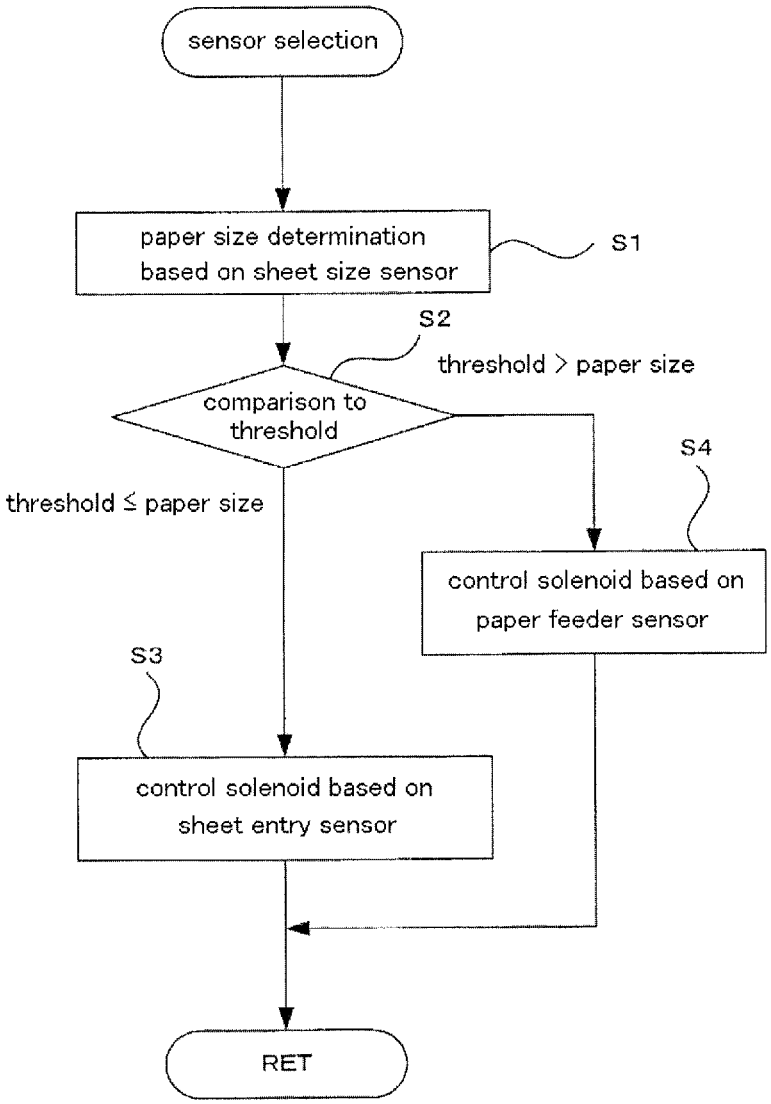
FIG. 18 is a flow chart of sensor selection process according to the embodiment of the present invention.

The solenoid on-signal generator 100 sets a drive start time based on the output of the paper feed sensor FS instead of the sheet entry sensor 7 when the size of the sheet S is smaller than a predetermined threshold. The processing flowchart is given in FIG. 18.

When the sheet S is small, merely driving the stopping members 63 and 66 based on the output from the sheet entry sensor 7 may not be enough. This is when T1 in FIG. 15 is shorter than or approximately the same as the time delay ΔT. At this time, if the driving start time is set based on the output of the paper feeder sensor FS, T1 can be made sufficiently long, and thus the stopping members 63 and 66 may make contact at an appropriate location.

The aforementioned threshold is established based on the relationship between T1 and ΔT, for example. For example, when the corrected result from the corrector 1004 is zero or smaller than a predetermined value (value with an allowance for heightening reliability), the output of the paper feeder sensor FS is used.

Operation of the sheet folding device including the sheet deceleration means 6*a* and 6*b* configured as described above will be described.

Figure 19:
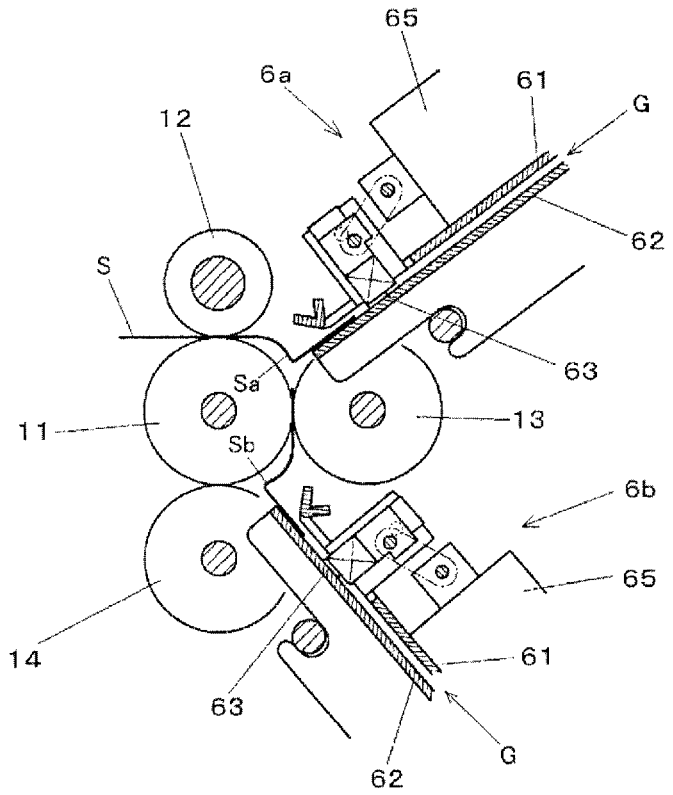
FIG. 19 is an operational schematic diagram of the device according to the embodiment of the present invention.

FIG. 19 illustrates that the pad 63 of both of the sheet deceleration means 6*a* and 6*b* is at the pressing location; however, in actuality, they are at either the waiting location or the pressing location depending on the situation, as described below.

In FIG. 19, the sheet S first passes between the driving roller 11 and the follower roller 12 and is fed into the gap G of the sheet deceleration means 6*a* located above them.

At this time, the pad 63 is at the waiting location and allows entry of the sheet S into the gap G.

When the sheet S is detected by the sheet entry sensor 7, the solenoid 65 is driven based on that detection signal, thereby moving the pad 63 to the pressing location.

The sheet S is pressed onto the inner surface of the gap G by the pad 63. The sheet S is then sandwiched between the pad 63 and the lower guide plate 62 and stopped from traveling.

The back end side of the sheet S is between the driving roller 11 and the follower roller 12 and is continued to be sent forward (downstream) from these rollers 11 and 12. The sheet S is bent downward between the driving roller 11 and the pad 63. The bent portion Sa is caught between the driving roller 11 and the follower roller 13.

The bent portion Sa of the sheet S is folded by the driving roller 11 and the follower roller 13, and the sheet S with the bent portion as the front end is fed into the gap G of the sheet deceleration means 6*b* located below.

In the same manner as with the sheet deceleration means 6*a*, the sheet S is bent and the bent portion Sb is caught between the driving roller 11 and the follower roller 14.

The sheet S that has passed between the driving roller 11 and the follower roller 14 is ejected to the outside through the conveyance path 19.

Figure 20:
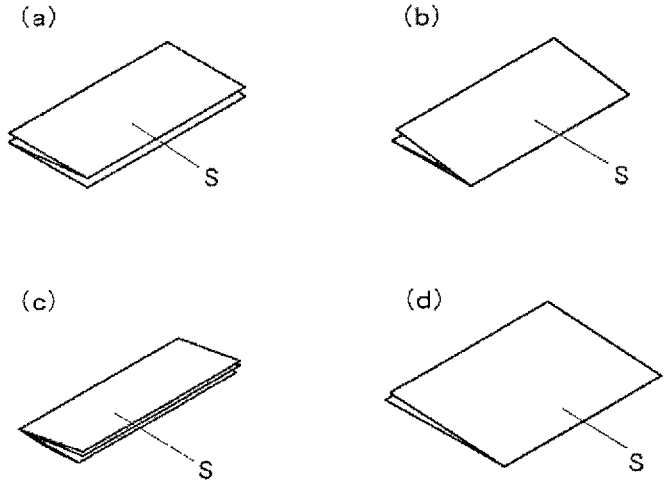
FIG. 20 is a schematic diagram explaining folding methods for a sheet using the device according to the embodiment of the present invention.

The sheet folding device according to the embodiment of the present invention allows various folding methods illustrated in FIG. 20. FIG. 20(*a*) illustrates an outer threefold method, FIG. 20(*b*) illustrates an inner threefold method, and FIG. 20(*c*) illustrates a fourfold method.

A shutter device, omitted from the drawing, adjacent to either one of the sheet deceleration means 6*a* and 6*b* may be provided so as to prohibit entry of the sheet S into the gap G such that the sheet S is decelerated only by the other sheet decelerating means, thereby folding the sheet in two as shown in FIG. 20(*d*).

Which folding method of FIG. 20 is used depends on the operating timing of the pad 63. The operating timing is set by the solenoid on-signal generator 100.

The present invention is not limited to the configuration given above. Alternatively, for example, the pad 63 and its transfer means 64 may be provided on the bottom side of the lower guide plate 62 such that the sheet S that has entered into the gap G will be pressed against the bottom (inner surface) of the upper guide plate 61 by the pad 63.

The paired upper and lower guide members forming the gap G are not limited to plate materials such as the upper guide plate 61 and the lower guide plate 62. The guide members may be configured by stacking and arranging in parallel a plurality of bars.

DESCRIPTION OF REFERENCE NUMERALS

6*a*, 6*b*: sheet deceleration means
7, 7*a*, 7*b*: sheet entry sensor
11: driving roller (sheet transportation means, sheet folding means)
12: follower roller (sheet transportation means)
13: follower roller (sheet transportation means, sheet folding means)
14: follower roller (sheet transportation means, sheet folding means)
17: motor (sheet transportation means driving part)
61: upper guide plate
62: lower guide plate (guide member)
63: pad (pressing member, stopping member)
64: pad transfer means
65: solenoid (stopping member driving part)
66: pad fixing bar (pressing member attachment, stopping member)
100: solenoid on-signal generator
1001: solenoid on-location setting part (drive starting information setting part)
1002: counter
1003: comparator
1004: corrector
101: solenoid driving time setting part (driving time setting part)
CONT: controlling unit
ES: paper ejection sensor
FS: paper feed sensor
G: gap
PS: power supply
RE: rotary encoder
S: sheet
SS: sheet size sensor
SW: switch

The invention claimed is:

1. A sheet folding device comprising: sheet transportation means for transporting a sheet along a predetermined route; sheet deceleration means for decelerating at least a part of the sheet while being transported by the sheet transportation means; folding means for folding a part of the sheet that is bent as the result of deceleration by the sheet deceleration means; and a control unit for controlling the sheet deceleration means; wherein the sheet deceleration means comprises a guide member for receiving the sheet while being transported by the sheet transportation means;

a stopping member that comprises: a plate-like pressing member having a predetermined thickness and a pressing member attachment having the pressing member on an end surface facing the sheet and is rotatably held at a predetermined fulcrum, wherein an edge of the pressing member presses the sheet traveling along the guide member against the guide member; and a stopping member driving part for rotating the stopping member around the fulcrum; wherein the stopping member is positioned at a waiting location where the pressing member does not touch the sheet or at a pressing location where the edge of the pressing member touches the sheet but the surface of the pressing member does not entirely touch the sheet;

the stopping member moves from the waiting location to the pressing location by rotating in the same direction as the traveling direction of the sheet, and returns from the pressing location to the waiting location by rotating in the opposite direction to the traveling direction of the sheet; and the stopping member driving part rotates the stopping member from the waiting location to the pressing location in compliance with an instruction from the control unit, an operation panel for inputting a folding method for the sheet; a sheet size sensor for detecting the size of the sheet; and a sheet transportation means driving part for driving the sheet transportation means in order to transfer the sheet, wherein the sheet deceleration means comprises a sheet entry sensor for detecting entry of the sheet, and the control unit comprises:

a drive starting information setting part for setting drive starting information for the stopping member driving part based on an instruction on the folding method for the sheet from the operation panel and an output of the sheet size sensor; and a driving time setting part for storing a driving time established in correspondence with the transporting velocity of the sheet and/ or the size of the sheet, wherein the control unit starts driving the stopping member driving part based on the output from the sheet entry sensor and the driving start information established by the driving start information setting part, and acquires the corresponding driving time from the driving time setting part based on a signal from the sheet size sensor and/ or the driving velocity of the sheet transportation means driving part, so as to drive the stopping member driving part based on the acquired driving time.

2. The sheet folding device of claim 1, wherein the control unit further comprises a corrector for storing an adjusted value specified in compliance with the driving velocity of the sheet transportation means driving part, and the control unit acquires the adjusted value from the corrector based on the driving velocity of the sheet transportation means driving part, so as to correct a driving time of the stopping member driving part in accordance with the acquired adjusted value.

3. The sheet folding device of claim 1, further comprising a paper feeder sensor for detecting that a sheet has been received by the sheet transportation means, wherein, when the size of the sheet is smaller than a predetermined threshold, the driving time start information setting part of the control unit sets driving start information for the stopping member driving part based on an output of the paper feeder sensor instead of the sheet entry sensor.

* * * * *